US005307768A

United States Patent [19]

Beier et al.

[11] Patent Number: 5,307,768

[45] Date of Patent: May 3, 1994

[54] CAMSHAFT ARRANGEMENT HAVING ANGULARLY MOVABLE CAMS

[75] Inventors: Alfred Beier, Braunschweig; Dietrich Distler; Panagiotis Adamis, both of Wolfsburg, all of Fed. Rep. of Germany

[73] Assignee: Volkswagen AG, Wolfsburg, Fed. Rep. of Germany

[21] Appl. No.: 106,543

[22] Filed: Aug. 16, 1993

[30] Foreign Application Priority Data

Aug. 17, 1992 [DE] Fed. Rep. of Germany ..... 4227128
Jul. 3, 1993 [DE] Fed. Rep. of Germany ..... 4322246

[51] Int. Cl.[5] ..... F01L 1/04; F01L 1/34

[52] U.S. Cl. ..... 123/90.17; 123/90.6; 74/568 R

[58] Field of Search ..... 123/90.15, 90.17, 90.51, 123/90.6; 74/567, 568 R

[56] References Cited

U.S. PATENT DOCUMENTS

| | | | |
|---|---|---|---|
| 4,522,085 | 6/1985 | Kane | 123/90.17 |
| 4,771,742 | 9/1988 | Nelson et al. | 123/90.17 |
| 4,870,872 | 10/1989 | Parsons | 74/568 R |
| 5,105,679 | 4/1992 | Voigt | 123/90.17 |
| 5,158,049 | 10/1992 | Neumann | 123/90.17 |
| 5,161,429 | 11/1992 | Elrod et al. | 123/90.17 |
| 5,168,772 | 12/1992 | Adamis et al. | 123/90.17 |
| 5,181,486 | 1/1993 | Gyurovits | 123/90.17 |
| 5,239,885 | 8/1993 | Voigt | 123/90.17 |

FOREIGN PATENT DOCUMENTS

| | | | |
|---|---|---|---|
| 3225686 | 1/1984 | Fed. Rep. of Germany . | |
| 3234640 | 3/1984 | Fed. Rep. of Germany . | |
| 3732687 | 4/1988 | Fed. Rep. of Germany | 123/90.17 |
| 3934848 | 4/1991 | Fed. Rep. of Germany | 123/90.17 |
| 4100087 | 7/1991 | Fed. Rep. of Germany . | |
| 4122251 | 1/1992 | Fed. Rep. of Germany | 123/90.17 |
| 133409 | 8/1983 | Japan | 123/90.17 |

*Primary Examiner*—E. Rollins Cross
*Assistant Examiner*—Weilun Lo
*Attorney, Agent, or Firm*—Brumbaugh, Graves, Donohue & Raymond

[57] ABSTRACT

A camshaft arrangement has a series of cams mounted on a camshaft for limited angular motion relative to the camshaft in response to force applied by a closing spring for the associated valve and a series of fixed cams separated by spacer sleeves. All of the cams and spacer sleeves are assembled on the shaft by sliding them on from one end and are retained between stops on the shaft so that they seal recesses in the movable cams which are filled with a damping fluid.

10 Claims, 4 Drawing Sheets

CAMSHAFT ARRANGEMENT HAVING ANGULARLY MOVABLE CAMS

BACKGROUND OF THE INVENTION

This invention relates to camshafts having cams which can move angularly to a limited extent on the camshaft.

Limited angular motion of individual cams on a camshaft is important to provide, for example, variable valve lift curves for the intake valves of an internal combustion engines. German Patent No. 32 34 640 and German Offenlegungsschrift No. 41 00 087 disclose camshaft arrangements of this kind for intake valves of internal combustion engines in which the limited angular motion of the cams relative to the camshaft on which they are mounted permits a relatively broad valve lift curve to be produced at high engine speeds, but a narrow valve lift curve at low speeds. This is accomplished by displacement of the valve closing time, the ascending flank of the lift curve being independent of rotational speed. In principle, however, it is possible instead to design such a camshaft arrangement so that the ascending flank of the valve lift curve is variable.

The limited angular motion of the cam is permitted by providing an angular recess in the cam adjacent to the camshaft so that an element projecting from the shaft is angularly movable in the recess. To assure a continuous valve lift curve and to avoid any interruption of contact between the cam surface and the valve, it is important to provide a damping fluid in the angular recess accommodating the projecting element. This in turn requires a seal capable of retaining the damping fluid at every speed range of the camshaft, i.e., at all engine speeds.

Insofar as the above-mentioned prior art discloses any solution to this problem, for example, German Offenlegungsschrift No. 41 00 087, there are comparatively few designs for angularly movable cams.

Another problem to be considered is the prevention of excessive friction between the cam-driving element associated with the camshaft, which has a flat outer surface in the prior art arrangements, and the adjacent inner surface of the angular recess in the cam. This is especially important when the projecting element comprises an additional contoured part which is inserted in a camshaft groove extending parallel to the axis of the camshaft and is subject to centrifugal forces, as in the arrangement disclosed in German Patent No. 32 34 640. If the cam-driving element is integral with the camshaft or is a constituent part of the shaft, as in the arrangement described in German Offenlegungsschrift No. 41 00 087, extremely precise fabrication is required to avoid undesirable wear.

SUMMARY OF THE INVENTION

Accordingly, it is an object of the present invention to provide a camshaft arrangement having angularly movable cams which overcomes the disadvantages of the prior art.

Another object of the invention is to provide such a camshaft which permits variability of the valve lift curve under the influence of the force of valve-closing springs and the camshaft speed alone so that, at practically no additional cost, flawless performance of the camshaft, in particular freedom from leakage and from wear, is assured.

These and other objects of the invention are attained by providing a camshaft having angularly movable cams with an angular recess therein and a cam-driving roller rotatably supported in fixed angular position on the camshaft along with adjacent spacer sleeves positioned with respect to the angularly movable cam to permit a controlled escape of damping fluid from the recess and to receive the ends of the cam-driving roller which project beyond the sides of the cam.

A special advantage of this arrangement is its convenience of fabrication. All of the components are assembled onto the camshaft, including both fixed and limitedly-movable cams and the spacing sleeves between the cams, by simply sliding them onto the shaft and retaining them in longitudinally-fixed position on the shaft by end stops positioned so as to permit angular motion of the movable cams while maintaining a close engagement of the cam recesses accommodating the cam-driving elements. Because the cam-driving elements are in the form of rollers which are merely retained in place by depressions in the camshaft while permitting rotary motion, and the ends of the rollers are received in the adjacent spacer sleeves, optimum wear performance is achieved. The rollers have no sharp edges that might cause wear on the boundary walls of the camshaft recesses in which they are mounted. Also, the recesses do not hold the rollers in place since the openings in the adjacent spacer sleeves are provided and designed for that purpose.

It will be understood that the choice of materials for surfaces sliding upon each other in the limited angular motion of the cams may be important to wear resistance and tightness. For this purpose, it is advantageous to make the rollers of depth-hardened material, while the camshaft and the angularly movable cams are nitrocarbided and surface-oxidized, for example, by the method described in German Patent No. 32 25 686 for heat-treating the surface of a part, also known as the NiOx process.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
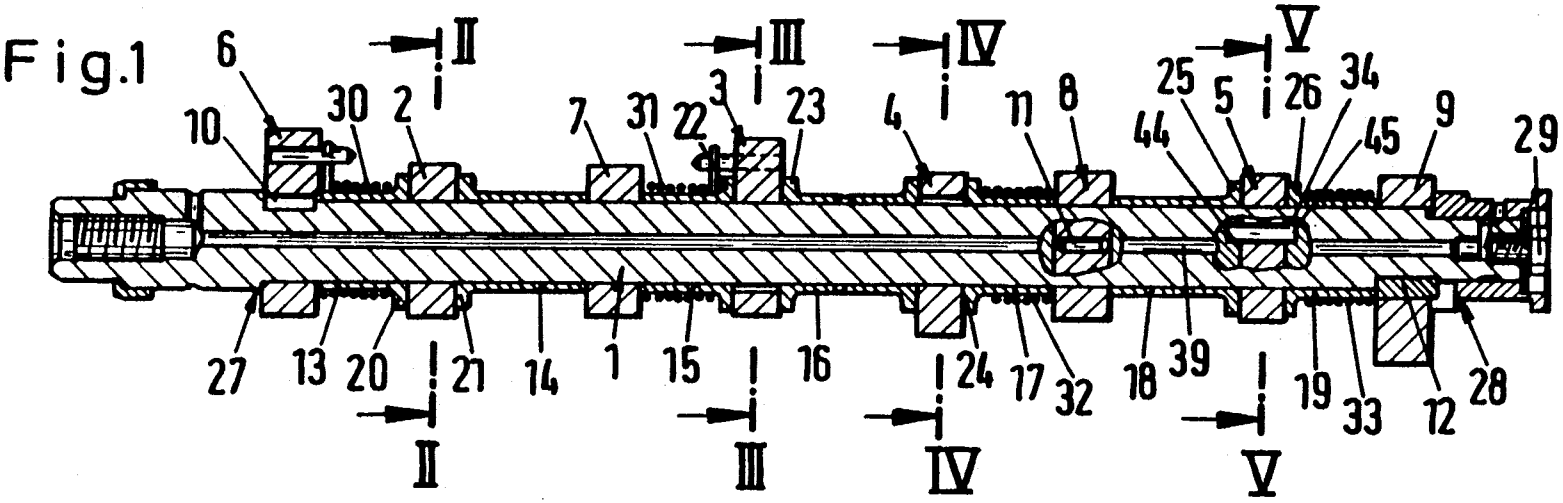
FIG. 1 is a view in longitudinal section showing a representative embodiment of a camshaft for a four-cylinder internal combustion engine arranged in accordance with the invention.

In each of the illustrations shown in FIGS. 2-5, it is assumed that the camshaft rotates in the clockwise direction as seen in the drawings.

The typical camshaft of the invention shown in FIGS. 1–5 includes a camshaft 1, four intake valve cams 2, 3, 4 and 5 associated with corresponding combustion chambers of the engine, and four exhaust valve cams 6, 7, 8 and 9, also associated with the corresponding combustion chambers. The camshaft arrangement may be assembled by sliding the cams in the appropriate order, together with intervening spacers, onto the camshaft 1 from the righthand end as seen in FIG. 1. All of the exhaust valve cams 6–9 are mounted on the shaft 1 in angularly fixed position by way of pins 10, 11 and 12, for example, which are received in corresponding facing grooves on the cam and the camshaft. On the other hand, the intake valve cams 2–5 are supported on the camshaft 1 for limited motion over a preassigned angular range about the axis of the camshaft as will be described hereinafter.

The distances between adjacent cams on the camshaft are maintained by a series of spacer sleeves 13, 14, 15, 16, 17 18 and 19 having shoulder-like enlargements 20, 21, 22, 23, 24, 25 and 26 on their ends which face toward the inlet cams 2, 3, 4 and 5. These shoulders are arranged to provide engagement with the angularly movable cams of predetermined tightness while permitting the required angular motion of these cams. The term "predetermined tightness" means that specified gaps are provided between the adjacent surfaces for the throttled escape of damping fluid from the cam recesses. It may be expedient in some cases to adjust the gap in accordance with the viscosity of the damping fluid by a suitable choice of materials for the camshaft 1 and the parts carried thereon.

All of the foregoing elements carried by the shaft 1 and assembled by sliding them onto one end of the shaft are retained between a stop formed by a shoulder 27 at the left end of the shaft as seen in FIG. 1 and a stop 28 retained by a screw 29 screwed into the shaft 1 at the right end.

Referring now to FIGS. 2, 3, 4 and 5 and considering the situation in the region of the four angularly movable intake valve cams 2, 3, 4 and 5, it will be seen that these cams are staggered in the circumferential direction according to the lift phases of the corresponding intake valves (not shown) which are positioned directly below the cams, as seen in the drawing, as dictated by the operation of the engine. In the case of the cam 2, the corresponding intake valve has just assumed its closed position, whereas in the case of the cam 4, the corresponding intake valve is just reaching its maximum opening position. The intake valves actuated by the cams 3 and 5 are in their closed position. In their relative angular position with respect to the camshaft 1 shown in FIGS. 2, 3, 4 and 5, the intake valve cams are prestressed by corresponding springs 30, 31, 32 and 33 which are linked to the adjacent exhaust valve cams, as shown in FIG. 1.

Figure 5:
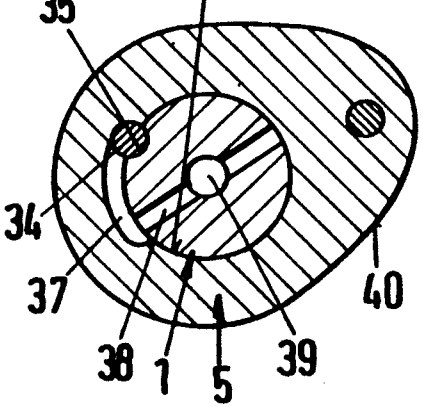
FIGS. 2, 3, 4 and 5 are cross-sectional views of the embodiment shown in FIG. 1, taken along the lines indicated by corresponding Roman numerals in FIG. 1.
Figure 4:
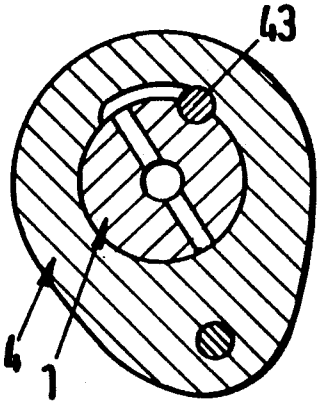
Figure 3:
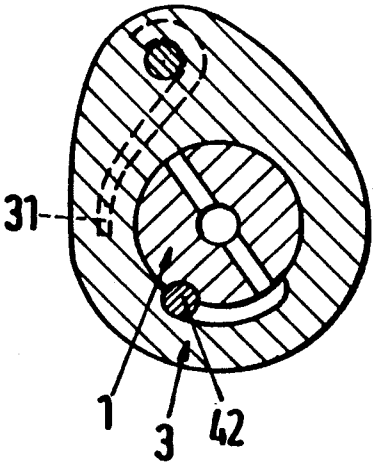
Figure 2:
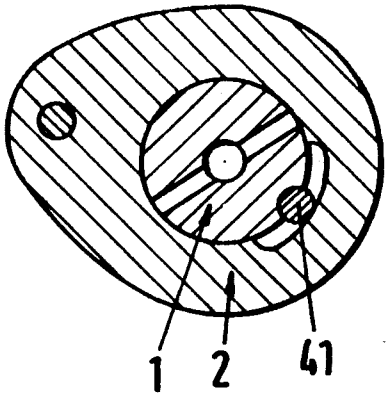

Since all of the intake valve cams 2, 3, 4 and 5 have the same design and operation, it will be sufficient to explain in detail the angular relationship between cam and shaft 1 during operation by reference to the intake valve cam 5, i.e., in terms of FIG. 5.

The limited angular motion connection comprises a cam-driving element 34 in the form of a roller received in a trough-like depression 35 which extends parallel to the axis of the camshaft 1 so as to permit rotary motion and an angular recess 37 in the adjacent part of the cam 5 which is spaced from the adjacent part of the shaft 1 and receives the roller 34 and extends over a predetermined angular range. The recess 37 is in flow communication with an axial passage 39 in the camshaft 1 by way of a transverse passage 38 or, if desired, a plurality of axially adjacent transverse passages in the camshaft 1, and the axial passage 39, in turn, is connected to the oil supply for the engine. In this case, the oil serves as a damping fluid for damping the relative angular motion between the cam 5 and the shaft 1.

In the angular position shown in FIG. 5, the cam 5 is forced in the clockwise direction against the driving roller 34 and the shaft 1 by the valve-closing spring. When the associated valve begins to close, i.e., when the trailing flank 40 of the cam 5 has passed the shaft of the lift valve, the force applied by the valve-closing spring then forces the cam 5 in the clockwise direction relative to the roller 34, producing an accelerated closing of the lift valve, which is damped by the damping fluid within the recess. This advance of the time of closing of the valve is dependent on the rotational speed of the cam.

As may be seen in FIG. 1, the cam-driving roller 34, as well as the driving rollers 41, 42 and 43 of the other intake valve cams 2, 3 and 4, is longer than the axial length of the corresponding cam 5, so that its end portions project from the cam and are received in recesses 44 and 45 in the faces of the adjacent spacer sleeves 18 and 19. These recesses 44 and 45 represent the actual support for the driver roller 34. This prevents contact of the driver roller 34 with the radially outer boundary surface of the recess 37 which receives the roller and consequently prevents wear at this point.

The tight contact between the boundary wall of the hole 36 in the cam and the periphery of the shaft 1 is assured by positioning the driving connection between the roller 34 and the end of the slot 37 substantially beneath the root circle portion of the cam 5.

Figure 6:
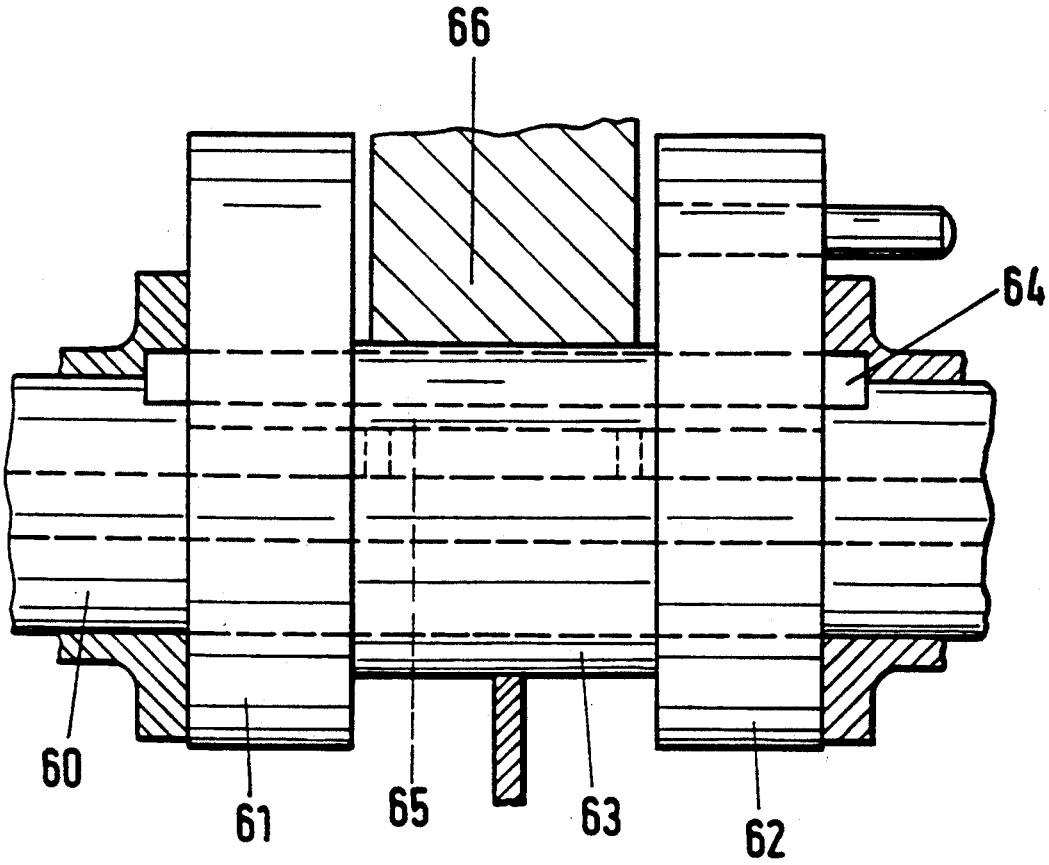
FIG. 6 is a side view of a portion of a camshaft showing the arrangement of a further representative embodiment of the invention for an engine having two inlet valves per combustion chamber.

FIG. 6 shows a portion of a camshaft arrangement having two cams 61 and 62 which are jointly angularly movable over a predetermined angular range with respect to a camshaft 60. As illustrated, the two cams have the same angular orientation, i.e., the lift valves associated with them are actuated simultaneously, or simultaneously assume their closed positions. A connecting sleeve 63 extends between the two cams 61 and 62, and the sleeve, like the spacer sleeves described previously, is rotatably mounted on the shaft 60 and provides a rotationally fixed connection between the two pivotable cams 61 and 62. A cam-driving roller 64 is common to the two cams 61 and 62, i.e., it traverses a recess in the connecting sleeve 63 which is of such shape that it constitutes a single recess 65 extending through the three parts 61, 62 and 63. The configuration and function of this recess as a cam-driving element between the cam and the camshaft 60 has been explained previously.

The connecting sleeve 63 passes beneath or within the bearing block 66 for the entire camshaft, thus advantageously achieving support for restoring the cams 61 and 62 to their initial position by bearing friction after closure of the associated lift valves. If desired, springs corresponding to the parts 30–33 in FIG. 1 may be dispensed with in this case.

As is apparent from the embodiments described above, in order to maintain predetermined valve-opening times in those embodiments, it is important to maintain a sealing effect between the roller which is rotatably mounted in the camshaft and the radial boundary wall of the cam recess facing the roller. This means that for different camshaft designs, rollers having different diameters corresponding to the camshafts must be kept in stock. In such cases, a roller design is of advantage as described in the following with reference to FIGS. 7 and 8.

Figure 7:
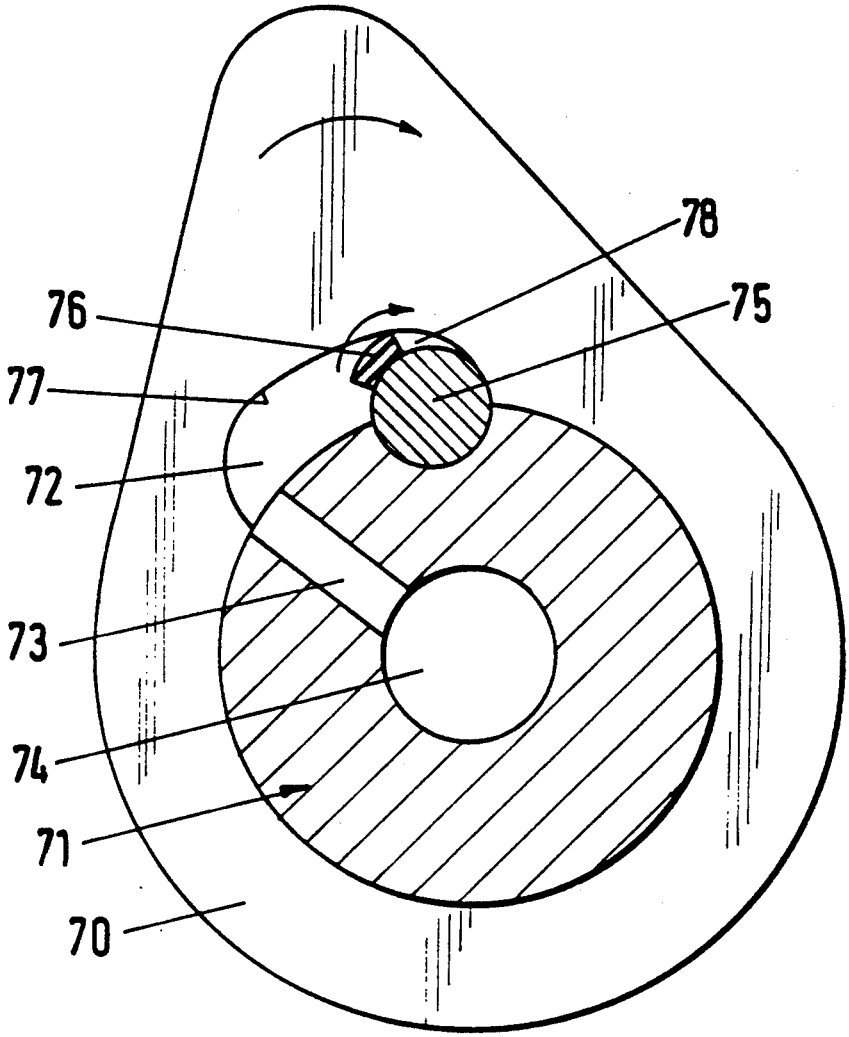
FIG. 7 is a cross-sectional view of a cam showing another embodiment of the invention.

Referring first to FIG. 7, a cam 70 is supported for limited angular motion on a camshaft 71 which has a recess 72, also termed a damping space. The recess 72 is at times in flow communication with a central damping fluid supply 74 in the camshaft 71 by way of a transverse passage 73 in the camshaft. As in the embodiments previously described, a roller 75 is supported for rotation by the camshaft 71. In this case, however, the roller 75 is provided with a sealing ledge 76 which is forced clockwise in the direction of the arrow in FIG. 7 into snug contact with the inner surface 77 of the recess 72 by the pressure of the damping fluid in the recess 72 and also by the force of a spring and/or by centrifugal force. Since the ledge 76 provides the seal with the recess wall 77, there may be a gap 78 between the roller 75 and the wall 77. Consequently, only one roller and sealing ledge design is required for various cam arrangements having different recess dimensions. A soft material, for example, punchable sheet metal, is used for the sealing ledge 76 to achieve snug contact with the surface 77.

Figure 8:
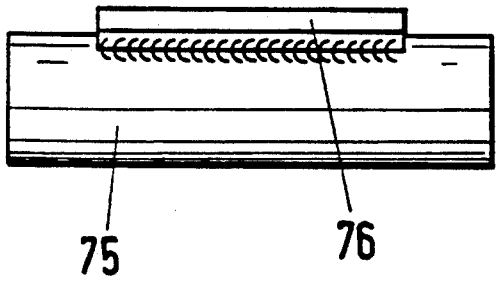
FIG. 8 is a fragmentary longitudinal sectional view of the cam shown in FIG. 7.

As shown in FIG. 8, the roller 75 and the sealing ledge 76 may, for example, be connected together by laser welding. The sealing ledge 76 has, of course, the same length as the length of the recess 72 measured perpendicular to the plane of the drawing in FIG. 7.

Figure 9:
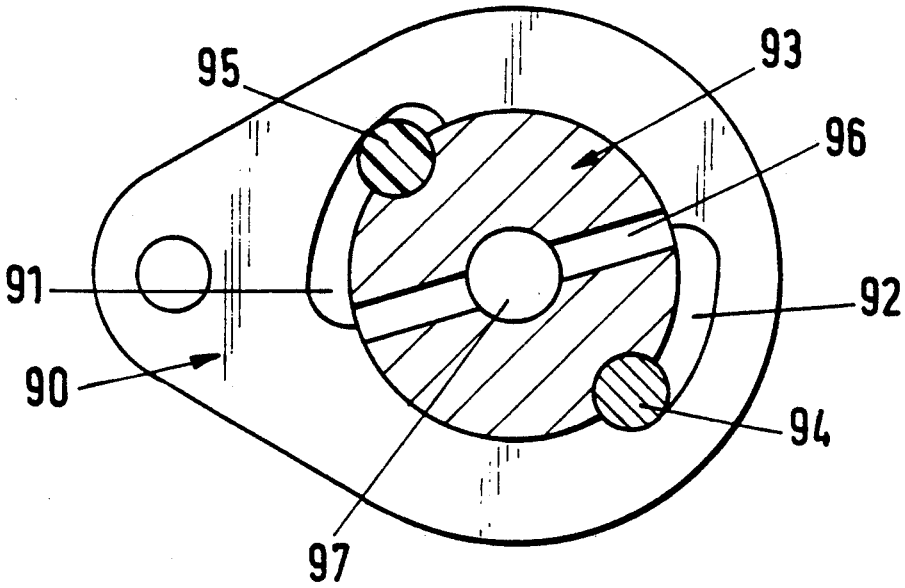
FIG. 9 is a cross-sectional view of a cam showing still another embodiment of the invention.

Finally, FIG. 9 is a cross-sectional view of an arrangement in which a cam 90 is formed with two diametrically opposed recesses 91 and 92, and a camshaft 93 is provided with two diametrically opposed rollers 94 and 95. The two recesses 91 and 92 are at times in flow communication with a central supply 97 of damping fluid in the camshaft 93 by way of a transverse passage 96. This "two-chamber" arrangement, in which one of the rollers, in this instance the roller 95, may consist of a resilient sealing material, provides improved oil damping and, in case of oil deficiency, improved emergency damping properties, especially if the resilient roller 95, as shown, engages the end of its recess before the other roller 94.

The invention thus provides a camshaft arrangement having angularly movable cams which can be assembled conventionally in mass production and provides high wear resistance in use.

Although the invention has been described herein with reference to specific embodiments, many modifications and variations therein will readily occur to those skilled in the art. Accordingly, all such variations and modifications are included within the intended scope of the invention.

We claim:

1. A camshaft arrangement preferably, for an internal combustion engine comprising a camshaft, at least one cam mounted thereon for angular motion relative to the camshaft over a predetermined angular range and having a through-hole traversed by the camshaft, and coupling means defining the angular range of motion of the cam and comprising a roller rotatably supported with respect to the camshaft and a recess in the cam adjacent to the through-hole and accommodating the roller with peripheral play and arranged to receive a damping fluid, and a pair of spacer sleeves having faces abutting the angularly movable cam, the cam and the spacer sleeves being assembled on the camshaft by sliding motion from one end of the camshaft, a pair of stops on the camshaft for retaining the cam and spacer sleeves in position so that the faces of the spacer sleeves abutting the angularly movable cam substantially seal the recess in the cam while permitting angular motion of the cam and leaving predetermined gaps for the damping fluid, the abutting faces of the spacer sleeves having openings to receive and support the ends of the roller projecting beyond the cam.

2. A camshaft arrangement according to claim 1 wherein one of the stops comprises a threaded part screwed onto one end of the camshaft.

3. A camshaft arrangement according to claim 1 wherein the recess in the cam coupling is located substantially beneath a root circle portion of the cam.

4. A camshaft arrangement according to claim 1 wherein the roller consists of a depth-hardened material and the camshaft and the angularly movable cam consist of nitrocarbided, surface-oxidized materials.

5. A camshaft arrangement according to claim 1 including a further cam mounted for angular motion relative to the camshaft and a connecting member joining the cam and the further cam in rotationally fixed relation and extending beneath a camshaft bearing.

6. A camshaft arrangement according to claim 1 wherein the materials of the components mounted on the camshaft have coefficients of thermal expansion selected so that the width of the predetermined gaps increases with falling temperature as the viscosity of the damping fluid is increased.

7. A camshaft arrangement according to claim 1 including a sealing ledge associated with the roller and extending inside the recess for snug contact with a boundary wall of the recess under the pressure of the damping fluid.

8. A camshaft arrangement according to claim 7 wherein a gap is provided between the roller and the boundary wall of the recess.

9. A camshaft arrangement according to claim 1 including a further roller rotatably supported with respect to the camshaft and a further recess in the cam adjacent to the through-hole and accommodating the further roller with peripheral play and arranged to receive a damping fluid, and a central damping fluid supply communicating with the recess and the further recess in the camshaft.

10. A camshaft arrangement according to claim 9 wherein one of the roller and the further roller comprises a resilient material.

* * * * *